United States Patent [19]

Nouthuka et al.

[11] Patent Number: 4,572,134

[45] Date of Patent: Feb. 25, 1986

[54] DOUBLE CARBURETOR

[75] Inventors: Hirofumi Nouthuka; Mitsuo Ohfuji, both of Katsuta, Japan

[73] Assignees: Hitachi, Ltd.; Hitachi Automotive Eng. Co., Ltd., both of Tokyo, Japan

[21] Appl. No.: 644,693

[22] Filed: Aug. 27, 1984

[30] Foreign Application Priority Data

Aug. 29, 1983 [JP] Japan ..... 58-156446

[51] Int. Cl.[4] ..... F02M 7/12

[52] U.S. Cl. ..... 123/438; 261/DIG. 51; 261/DIG. 74

[58] Field of Search ..... 123/438, 437; 261/DIG. 51, DIG. 74

[56] References Cited

U.S. PATENT DOCUMENTS

| | | | |
|---|---|---|---|
| 2,070,009 | 2/1937 | Goodman | 123/437 |
| 4,103,657 | 8/1978 | Minami | 261/DIG. 74 |
| 4,416,236 | 11/1983 | Morozumi et al. | 123/438 |
| 4,434,762 | 3/1984 | McCabe | 123/438 |

*Primary Examiner*—Andrew M. Dolinar

*Attorney, Agent, or Firm*—Antonelli, Terry & Wands

[57] ABSTRACT

A double carburetor including a primary suction conduit and a secondary suction conduit located in a suction passage of an internal combustion engine equipped with a turbosupercharger for supplying supercharged air to a combustion chamber by means of a compressor driven by a turbine rotated by the energy of exhausts has an air-fuel ratio correcting control valve for a primary main fuel system of the primary suction conduit and another air-fuel ratio correcting control valve for a secondary main fuel system of the secondary suction conduit. The carburetor also has a drive unit which is operative, when the turbosupercharger is put into action, to actuate the air-fuel ratio correcting control valves for the primary and secondary main fuel systems to correct the air-fuel ratio of fuel-air mixtures supplied to the engine by increasing fuel flow or decreasing air flow therethrough.

14 Claims, 3 Drawing Figures

DOUBLE CARBURETOR

BACKGROUND OF THE INVENTION (1) Field of the Invention

This invention relates to a carburetor suitable for use with an internal combustion engine equipped with a turbosupercharger.

(2) Description of the Prior Art

An internal combustion engine equipped with a turbosupercharger having a turbine driven by exhaust gases by utilizing their energy to drive a compressor mounted in a suction passage to compress air drawn by suction before delivering it to a combustion chamber is capable of delivering air greater in volume by 30–40% than ordinary internal combustion engines.

In an internal combustion engine equipped with a turbosupercharger, the amount of oxygen in the air increases and the fuel-air mixture tends to become lean. This phenomenon has given rise to the problem that in an engine speed range in which the turbosupercharger is in action, the temperature of combustion might rise and knocking might occur, thereby causing deterioration of the drivability of an automotive vehicle and damaging the internal combustion engine.

A proposal has been made, in an internal combustion engine equipped with a turbosupercharger, to increase the volume of fuel injected through a fuel injection valve when the turbosupercharger is activated, as disclosed in Japanese Patent Laid-Open No. 28560/73, for example.

Besides the fuel injection system disclosed in the Japanese Patent Gazette noted hereinabove, a carburetor is also used as a fuel supply system for internal combustion engines. It is desired that similar measures be taken with respect to carburetors.

In the case of a carburetor, one only has to increase the diameter of a fuel jet of the carburetor to keep fuel-air mixtures from becoming lean. However, when this step is taken, fuel might be wasted or exhaust emissions might give rise to the problem of air pollution in an engine speed range in which supercharging does not take place. To obviate this problem, fuel should be increased in volume only when the turbosupercharger is put into action.

Meanwhile, a double supercharger including a primary carburetor and a secondary carburetor is becoming more popular than a single carburetor. This makes it necessary to control both the primary and secondary carburetors to increase the fuel flow when the turbosupercharger is activated. Particularly, the range of engine speeds in which the turbosupercharger is put into action matches the operation condition in which the primary and secondary carburetors are both actuated, so that it is necessary to control main fuel systems of the primary and secondary carburetors.

SUMMARY OF THE INVENTION

OBJECT OF THE INVENTION

This invention has as its object the provision of a double carburetor having a primary suction conduit and a secondary suction conduit suitable for use with an internal combustion engine equipped with a turbosupercharger which is capable of correcting the air-fuel ratio by increasing fuel flow through primary and secondary main fuel systems or decreasing air flow therethrough.

STATEMENT OF THE INVENTION

The outstanding characteristic of the invention is that air-fuel ratio correcting control valve means is provided to each of the main fuel system of the primary suction conduit and the main fuel system of the secondary suction conduit so that when the turbosupercharger is put into action, the air-fuel ratio correcting control valve means are actuated to correct the air-fuel ratio of a fuel-air mixture supplied to the engine either by increasing the fuel flow or decreasing the air flow.

The feature of the invention enables knocking to be avoided when the turbosupercharger is put into action while avoiding waste of fuel and deterioration of exhaust emissions, because the fuel flow through the primary and secondary suction conduits to the engine increases when the turbosupercharger is put into action.

DESCRIPTION OF THE PREFERRED EMBODIMENTS

Preferred embodiments of the invention will now be described by referring to the accompanying drawings.

Figure 1:
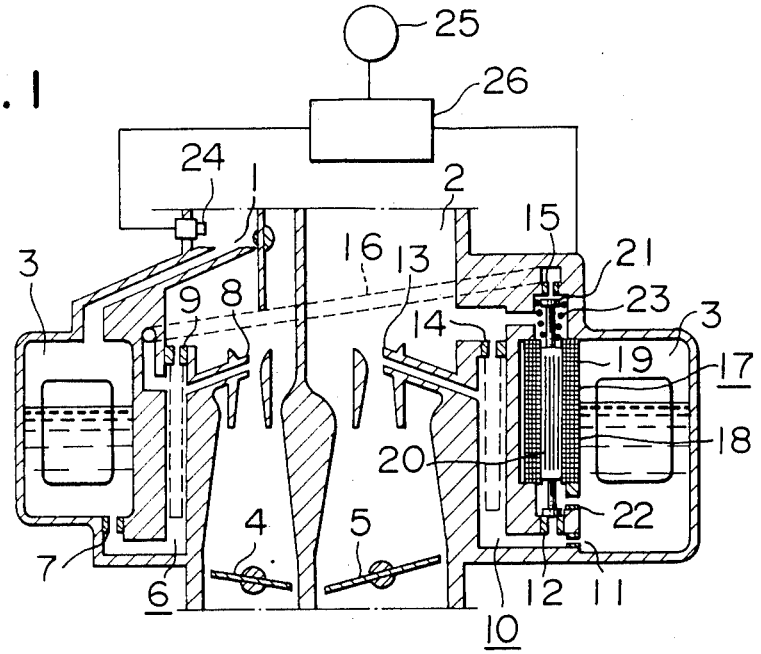
FIG. 1 is a sectional view of the carburetor comprising one embodiment of the invention.

FIG. 1 is a sectional view of the double carburetor comprising one embodiment of the invention located between an internal combustion engine and a turbosupercharger, not shown, for supplying supercharged air to the engine. The carburetor comprises a primary suction conduit 1, a secondary suction conduit 2, a float chamber 3, a primary throttle valve 4, and a secondary throttle valve 5. 6 is a primary main fuel passage communicating with the float chamber 3 via a primary main jet 7, with the primary suction conduit 1 via a primary nozzle 8 and with the primary suction conduit 1 via a primary air bleed 9. 10 is a secondary main fuel passage which communicates with the float chamber 3 via a secondary main jet 11 and an auxiliary fuel jet 12 and with the secondary suction conduit 2 via a secondary nozzle 13 and a secondary air bleed 14. 15 is an auxiliary air bleed allowing metered air to flow via an air passage 16 to the primary main fuel passage 6. 17 is a solenoid device mounted on the secondary suction conduit 2 comprising a casing 18, a coil 19 and a plunger 20. A bleed valve 21 movable between a full-open position and a full-closed position is mounted at an upper end of the plunger 20 to control the flow of air through the auxiliary air bleed 15, and a fuel valve 22 movable between a full-open position and a full-closed position is mounted at a lower end of the plunger 20 to control the flow of fuel through the auxiliary fuel jet 12. The bleed valve 21 and fuel valve 22 each constitute air-fuel ratio correcting control valve means. A spring 23 is mounted on the plunger 20 to bias the bleed valve 21 away from its valve seat and at the same time to bring the fuel valve 22 into engagement with its valve seat through the plunger 20. Meanwhile, the coil 19 is energized, the plunger 20 is moved upwardly against the biasing force of the spring 23, to bring the fuel valve 22 out of engagement with the valve seat and bring the bleed valve 21 into engagement with the valve seat. The solenoid device 17 is a sort of on-off device which is controlled by an on-off time ratio (or a so-called duty ratio) of an electrical signal of a control circuit 26 in accordance with a signal of a pressure sensor 24 mounted at the primary suction conduit 1 and an output of an rpm. sensor 25 for sensing the rpm. of the engine. The solenoid device 17 operates such that when no supercharged air acts on the primary suction conduit 1, the coil 19 is normally de-energized, to keep the auxiliary fuel jet 12 closed and the auxiliary air bleed 15 open. Thus, the diameters of the jets and bleeds are set at values which would satisfy the air-fuel ratio demanded by the engine when the jet 12 and air bleed 15 are in the aforesaid conditions. Each air-fuel ratio correcting control valve means is controlled in such a manner that the period of time during which the auxiliary fuel jet 12 remains open and the auxiliary air bleed 15 remains closed is prolonged as the rpm. of the engine rises, during the time the turbosupercharger is in operation.

In the carburetor of the aforesaid construction, the coil 19 is not energized when the turbosupercharger is inoperative, so that the plunger 20 causes the fuel valve 22 to close the auxiliary fuel jet 12 and makes the bleed valve 21 open the auxiliary air bleed 15, so that the carburetor functions as an ordinary carburetor.

When the turbosupercharger is put into action, the pressure sensor 24 senses a rise in air pressure and the rpm. sensor 25 senses an increase in the rpm. of the engine. The control circuit 26 decides upon the proportion of the fuel flow to be increased (or the duty ratio, in other words) and outputs a signal to the coil 19 which, upon being energized, causes the plunger 20 to open the fuel valve 22 and close the bleed valve 21.

When the secondary suction conduit 2 is inoperative, the fuel flow to the primary suction conduit 1 increases because the air flow from the auxiliary air bleed 15 decreases. However, even if the fuel valve 22 is brought to the open position, the fuel flow does not increase because no subatmospheric pressure produced by the venturi acts on the secondary nozzle 13.

Meanwhile, when the primary suction conduit 1 and secondary suction conduit 2 are both operative, the fuel flow to the primary suction conduit 1 increases as described hereinabove, and at the same time a subatmospheric pressure produced by the venturi acts on the secondary nozzle 13 of the secondary suction conduit 2 to supply fuel, so that the fuel flow increases by an amount corresponding to the opening of the fuel valve 22.

In the embodiment of the invention of the aforesaid construction shown in FIG. 1, by setting at suitable values an output representing a combination of the outputs of the pressure sensor 24 and rpm. sensor 25 and an electrical signal produced by the control circuit 26 having such output inputted thereto, it is possible to supply to the internal combustion engine fuel-air mixtures optimally corrected to suit the conditions of non-supercharged, partially loaded and supercharged, and high-speed and supercharged operations in the range of all the engine speeds. Particularly, it is possible to avoid knocking, deterioration of drivability of the automotive vehicle and damage to the internal combustion engine which might otherwise occur due to the lack of fuel in the condition of supercharged operation.

Figure 2:
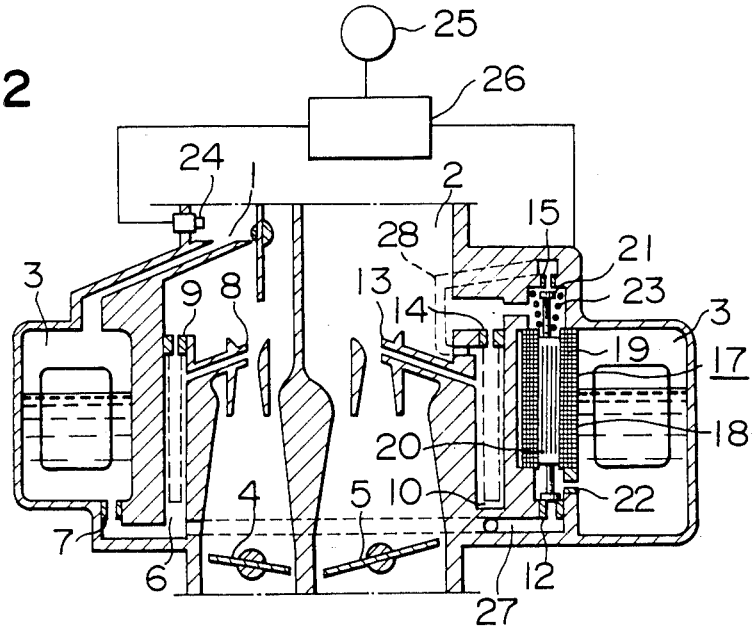
FIG. 2 is a sectional view of the carburetor comprising another embodiment.

FIG. 2 shows another embodiment of the invention which is distinct from the embodiment shown in FIG. 1 in that whereas in the embodiment shown in FIG. 1 correction of the air-fuel ratio is effected in the primary suction conduit and secondary suction conduit by varying the air flow and fuel flow resectively, correction is effected in the embodiment shown in FIG. 2 by varying the fuel flow for the primary suction conduit and by varying the air flow for the secondary suction conduit.

The embodiment shown in FIG. 2 has no air passage 16 of the embodiment shown in FIG. 1 but is provided with an auxiliary fuel passage 27 and an air passage 28. The auxiliary fuel passage 27 is connected to the primary main fuel passage 6 in parallel with the primary fuel jet 7, so as to supply fuel to the primary main fuel passage 6 through the auxiliary fuel jet 12 which mounts the fuel valve 22 as is the case with the embodiment shown in FIG. 1. The air passage 28 supplies air from the auxiliary air bleed 15 to the secondary main fuel passage 10 in parallel with the secondary air bleed 14, with the auxiliary air bleed 15 mounting the bleed valve 21 as is the case with the embodiment shown in FIG. 1.

In the embodiment of the aforesaid construction shown in FIG. 2, energization of the coil 19 increases the fuel flow supplied from each of the main fuel systems for the primary suction conduit and secondary suction conduit.

In the embodiment shown and described hereinabove, correction of the air-fuel ratio has been described as being effected by controlling the air flow for one of the primary suction conduit and secondary suction conduit and by controlling the fuel supply for the other suction conduit. However, the invention is not limited to these specific embodiments, and correction of the air-fuel ratio may be effected by controlling the air flow or fuel flow for the two suction conduits. When this is the case, some alternations would have to be incorporated in the arrangement of the passage shown in FIGS. 1 and 2.

Figure 3:
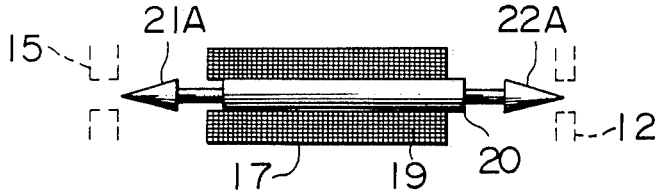
FIG. 3 is a sectional view of a modification of the solenoid device shown in FIGS. 1 and 2.

The solenoid device 17 shown and described hereinabove is constructed such that the plunger 20 effects on-off control. FIG. 3 shows a modified form of solenoid device 17 in which the plunger 20 performs a proportional operation. More specifically, the control circuit 26 produces an electrical signal representing a voltage whose value is continuously varied in accordance with changes in the rpm. of the engine, and the plunger 20 effects control, in proportion to the control signal of the control circuit 26, of valve bodies 21A and 22A which engage the auxiliary air bleed 15 and auxiliary fuel jet 12 respectively. The solenoid device of the constructional form shown in FIG. 3 can achieve the same effects as the solenoid device of the constructional form shown in FIGS. 1 and 2.

In the embodiments shown in FIGS. 1 and 2, only one solenoid device 17 is used, and the control circuit 26 has only to produce a single signal. Thus, the construction of the control circuit 26 is simplified as compared with that of a control circuit of a carburetor of the prior art in which two solenoid devices are required for each of the primary air-fuel ratio correcting control valve means and secondary air-fuel ratio correcting control valve means.

From the foregoing description, it will be appreciated that the invention enables the fuel flow through the primary and secondary main fuel systems to be increased when the turbosupercharger is put into action. This is conducive to avoidance of knocking when the turbosupercharger is put into action without the risks of fuel being wasted and the exhaust emissions being deteriorated.

What is claimed is:

1. A double carburetor comprising a primary suction conduit and a secondary suction conduit located in a suction passage of an internal combustion engine equipped with a turbosupercharger for supplying supercharged air to a combustion chamber by means of a compressor driven by a turbine rotated by the energy of exhausts, wherein the improvement comprises:

air-fuel ratio correcting control valve means for the primary suction conduit and air-fuel ratio correcting control valve means for the secondary suction conduit mounted in a primary main fuel system of a secondary main fuel system, respectively; and a drive unit for driving, when the turbosupercharger is put into action, said air-fuel ratio correcting control valve means for the primary suction conduit and secondary suction conduit to increase fuel flow through the primary main fuel system and secondary main fuel system.

2. A double carburetor as claimed in claim 1, wherein said air-fuel ratio correcting control valve means for the primary suction conduit is controlled in such a manner that it allows fuel flow through the primary main fuel system to increase and said air-fuel ratio correcting control valve means for the secondary suction conduit is controlled in such a manner that it allows air flow through the secondary main fuel system to decrease, when the turbosupercharger is put into action.

3. A double carburetor as claimed in claim 1, wherein said air-fuel ratio correcting control valve means for the primary suction conduit is controlled in such a manner that it allows air flow through the primary main fuel system to decrease and said air-fuel ratio correcting control valve means for the secondary suction conduit is controlled in such a manner that it allows fuel flow through the secondary main fuel system to increase, when the turbosupercharger is put into action.

4. A double carburetor as claimed in claim 2 or 3, wherein said air-fuel ratio correcting control valve means for the primary and secondary suction conduits are driven by the single drive unit.

5. A double carburetor as claimed in claim 2 or 3, wherein said drive unit comprises a solenoid device.

6. A double carburetor as claimed in claim 5, wherein said solenoid device has supplied thereto a duty signal under on-off control, and said air-fuel ratio correcting control valve means for the primary and secondary suction conduits are each movable between a full-open position and a full-closed position.

7. A double carburetor as claimed in claim 5, wherein said solenoid device has supplied thereto a proportional electrical signal, and said air-fuel ratio correcting control valve means of the primary and secondary suction conduits are each movable between a full-open position and a full-closed position.

8. A double carburetor as claimed in claim 1, wherein said drive unit includes a pressure sensor means in the primary suction conduit and an engine rpm sensor means such that the drive unit operates in response to a signal representing a combination of the outputs of the pressure sensor means and the engine rpm sensor means.

9. A double carburetor comprising:

a primary suction conduit and a secondary suction conduit in a suction passage of an internal combustion engine equipped with a compressor for supplying compressed air to a combustion chamber of the internal combustion engine;

air-fuel ratio correcting control valve means for said primary suction conduit and air-fuel ratio correcting control valve means for said secondary suction conduit in a primary main fuel system and a secondary mean fuel system, respectively; and a single electrical control means operatively connected to said fuel-air ratio correcting control valve means for the primary suction conduit and said fuel-air ratio correcting control valve means for the secondary suction conduit so as to simultaneously drive both of the control valve means such that both said control valve means increase fuel flow when said compressor is put into action.

10. A double carburetor as claimed in claim 9, wherein said air-fuel ratio correcting control valve means for the primary suction conduit is controlled to allow fuel flow through the primary main fuel system to increase and said air-fuel ratio correcting control valve means for the secondary suction conduit is controlled to allow air flow through the secondary main fuel system to decrease, when the compressor is put into action.

11. A double carburetor as claimed in claim 9, wherein said air-fuel ratio correcting control valve means for the primary suction conduit is controlled to allow air flow through the primary main fuel system to decrease and said air-fuel ratio correcting control valve means for the secondary suction conduit is controlled to allow fuel flow through the secondary main fuel system to increase, when the compressor is put into action.

12. A double carburetor as claimed in claim 9, wherein said single electrical control means includes a solenoid device which has supplied thereto a duty signal under on-off control, and said air-fuel ratio correcting control valve means for the primary and secondary suction conduits each being movable between a full-open position and a full-closed position.

13. A double carburetor as claimed in claim 9, wherein said single electrical control means includes a solenoid device which has supplied thereto a proportional electrical signal, and said air-fuel ratio correcting control valve means for the primary and secondary suction conduits each being movable between a full-open position and a full-closed position.

14. A double carburetor as claimed in claim 9, wherein said single electrical control means includes a pressure sensor means in the primary suction conduit and an engine rpm sensor means, such that said control means operates in response to a signal representing a combination of the outputs of the pressure sensor means and the engine rpm sensor means to provide optimal air-fuel mixture during supercharged operations in the range of all engine speeds.

* * * * *